US012595796B2

(12) United States Patent
Metz

(10) Patent No.: US 12,595,796 B2
(45) Date of Patent: Apr. 7, 2026

(54) METHOD AND CONTROL UNIT FOR OPERATING A COMPRESSOR

(71) Applicant: MAN Energy Solutions SE, Augsburg (DE)

(72) Inventor: Kolja Metz, Berlin (DE)

(73) Assignee: EVERLLENCE SE, Augsburg (DE)

( * ) Notice: Subject to any disclaimer, the term of this patent is extended or adjusted under 35 U.S.C. 154(b) by 0 days.

(21) Appl. No.: 19/068,496

(22) Filed: Mar. 3, 2025

(65) Prior Publication Data

US 2025/0283461 A1 Sep. 11, 2025

(30) Foreign Application Priority Data

Mar. 7, 2024 (DE) ..... 10 2024 106 595.8

(51) Int. Cl.
*F04B 49/22* (2006.01)

(52) U.S. Cl.
CPC ..... *F04B 49/22* (2013.01)

(58) Field of Classification Search
CPC .. F04D 27/0207; F04D 27/02; F04D 27/0215; F04D 27/0223; F04D 27/023
See application file for complete search history.

(56) References Cited

U.S. PATENT DOCUMENTS

2007/0000267 A1* 1/2007 Shibata ..... B01D 19/0068 62/238.6

FOREIGN PATENT DOCUMENTS

| | | |
|---|---|---|
| DE | 3544822 | 6/1987 |
| DE | 19528253 | 10/1997 |
| DE | 10304063 | 8/2004 |

* cited by examiner

*Primary Examiner* — Anthony Ayala Delgado
(74) *Attorney, Agent, or Firm* — COZEN O'CONNOR

(57) ABSTRACT

A method for operating a compressor. A flow rate of the process gas through the compressor is determined. Dependent on a measured inlet pressure of the compressor and a measured outlet pressure of the compressor, a delivery head of the compressor is determined. A surge limit controller, dependent on the flow rate and dependent on the delivery head determines a control variable for a control element interacting with the compressor such that the compressor is operated along a control line, which has a defined distance from the surge limit of the compressor. A proportion of steam of the process gas is determined, and the control line, along which the compressor is operated, is adapted dependent on the proportion of steam.

7 Claims, 2 Drawing Sheets

METHOD AND CONTROL UNIT FOR OPERATING A COMPRESSOR

BACKGROUND OF THE INVENTION

1. Field of the Invention

The disclosure relates to a method for operating a compressor and to a control unit for operating a compressor.

2. Description of Related Art

From practice it is known to operate a compressor with the help of a surge limit controller in such a manner that the compressor is operated along a control line which has a defined distance from the search limit of the compressor. It is known that the surge limit is dependent on the composition of the process gasses to be compressed by the compressor. In practice, the composition of a process gas to be compressed is therefore determined with the help of a gas chromatograph or a comparable gas analysis system in order to adapt the control line for the surge limit controller dependent on the composition of the process gas determined by the gas chromatograph. The gas analysis with the help of a gas chromatograph however requires a relatively long period of time so that a quick reaction of the surge limit controller to a changing composition of the process gas to be compressed is not ensured. Further, the use of gas chromatographs is expensive.

DE 35 44 822 A1, DE 195 28 253 C2 and DE 103 04 063 A1 each disclose methods for operating a compressor with a surge limit control.

SUMMARY OF THE INVENTION

There is a need for a method and for a control unit for operating a compressor which make it possible, within a very short time, in particular within the range of less than one second, to react to a changing composition of a process gas to be compressed and thus ensure a stable operation of the compressor along a control line which always has a defined distance from the surge limit of the compressor.

Starting out from this, one aspect of the present invention is based on the object of creating a new type of method for operating a compressor and a control unit for operating a compressor.

According to one aspect of the invention, a proportion of steam of the process gas or a variable corresponding to the proportion of steam is determined, wherein the control line, along which the compressor is operated, is adapted dependent on the proportion of steam or the variable corresponding to the proportion of steam.

It is proposed for the first time to determine the proportion of steam of the process gas or a variable corresponding to the proportion of steam and dependent thereon adapt the control characteristic along which the compressor is operated. A compressor, which serves for compressing a process gas with dynamically changing proportion of steam, can thus be operated stable at all times. One aspect of the invention is suitable in particular for compressing carbon dioxide as process gas with a dynamically changing proportion of steam.

Preferentially, the dewpoint of the process gas is measured in particular with the help of a dewpoint mirror hygrometer, and the proportion of steam is determined dependent on the dew point in particular dependent on the characteristic diagram or dependent on the characteristic curve. By way of a dewpoint mirror hygrometer, the dewpoint of the process gas and, dependent on the dew point, the proportion of steam can be determined within a short time with little expenditure and accordingly low costs. The proportion of steam can be determined in an order of magnitude of less than one second, in particular in the order of magnitude of 50 milliseconds in order to then adapt the control characteristic curve of the surge limit controller with the same dynamics.

Further, a temperature of the process gas is preferentially measured upstream of the compressor, wherein the control line, along which the compressor is operated, is also adapted dependent on the temperature of the process gas upstream of the compressor in particular dependent on the characteristic diagram or dependent on the characteristic curve. In particular when in addition the temperature of the process gas is measure upstream of the compressor and the control characteristic curve is not only adapted dependent on the proportion of steam but also dependent on the temperature of the process gas, in particular dependent on the characteristic diagram or dependent on the characteristic curve, the operation of the surge limit controller can be further improved in order to always operate the compressor in a stable operating range, i.e. with adequate distance from the surge limit.

Dependent on the proportion of steam or the variable corresponding to the proportion of steam a gas constant of the process gas is preferentially determined, wherein the control line, along which the compressor is operated, is adapted dependent on the gas constant of the process gas and thus dependent on the proportion of steam or the variable corresponding to the proportion of steam, in particular dependent on the characteristic diagram or dependent on the characteristic curve. This procedure is particularly preferred. Dependent on the proportion of steam, the gas constant of the process gas to be compressed is determined in order to then adapt the control characteristic curve dependent on the gas constant of the process gas to be compressed.

BRIEF DESCRIPTION OF THE DRAWINGS

Preferred further developments of the invention are obtained from the subclaims and the following description. Exemplary embodiments of the invention are explained in more detail by way of the drawing without being restricted to this. There it shows:

DETAILED DESCRIPTION OF THE PRESENTLY PREFERRED EMBODIMENTS

Figure 1:
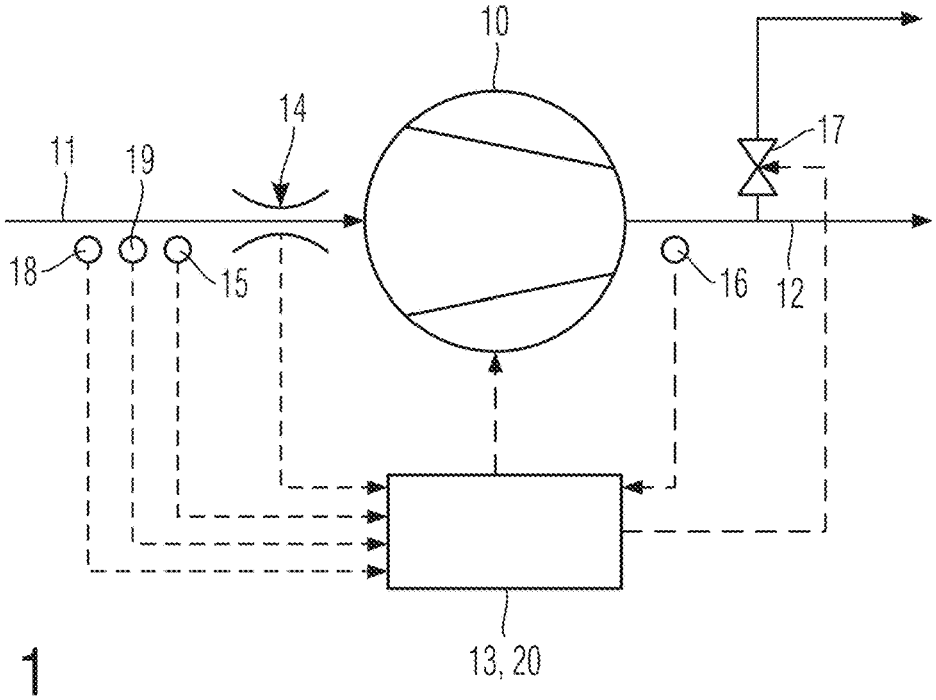
FIG. 1: is a schematic block diagram of a first compressor.

FIG. 1 shows in a highly schematic manner a compressor 10 for compressing a process gas, wherein process gas to be compressed is fed to the compressor 10 via a feed line 11, and wherein compressed process gas is discharged from the compressor 10 via a discharge line 12.

The operation of the compressor 10 is controlled by a control unit 13, wherein a surge limit controller 20 is part of the control unit 13.

The control unit 13 is provided with different input quantities, for example the input variable of a so-called effective pressure transducer 14.

The effective pressure transducer 14 measures a pressure differential in the feed line 11 upstream of the compressor 10, as a function of which the control unit 13, in particular the surge limit controller 20 of the same, determines a flow rate of the process gas through the compressor 10 or a variable corresponding to this flow rate, in particular dependent on a characteristic diagram or dependent on a characteristic curve.

The flow rate of the process gas through the compressor 10, or a variable corresponding to the flow rate is determined upstream of the compressor dependent on a pressure differential in the feed line.

Alternatively, to an effective pressure transducer, other measuring methods such as temperature-based measuring methods (hotwire anemometer), Coriolis mass flow measurements, ultrasound flow meters, laser-Doppler anemometer can also be employed in order to determine the flow rate.

Furthermore, FIG. 1 shows a pressure sensor 15 in the region of the feed line 11 and a pressure sensor 16 in the region of the discharge line 12, wherein the pressure sensor 15 measures and provides the control unit 13 with a suction pressure and thus an inlet pressure of the compressor 10 and the pressure sensor 16 an outlet pressure of the compressor 10. Dependent on the inlet pressure of the compressor 10 and dependent on the outlet pressure of the compressor 10, a so-called delivery head of the compressor 10 or a variable corresponding to the delivery head can be determined by the control unit 13, in particular by the surge limit controller, in particular dependent on a characteristic diagram or dependent on a characteristic curve.

Figure 3:
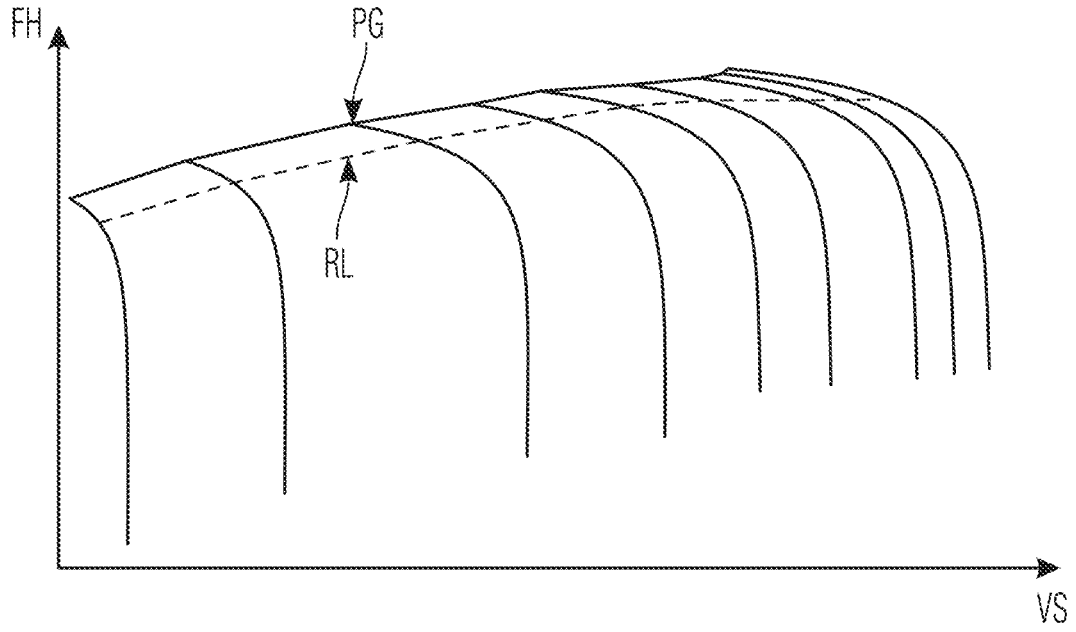
FIG. 3: is a first flow rate-delivery head characteristic diagram.

FIG. 3 shows an exemplary flow rate-delivery head characteristic diagram of the compressor 10, wherein in FIG. 3 the delivery head FH is plotted over the flow rate VS through the compressor 10. FIG. 3 shows a so-called surge limit PG, which separates the stable operating range from the unstable operating range of the compressor 10. The surge limit controller 20 of the control unit 13 operates the compressor 10 along the control line RL shown in FIG. 3 with adequate distance from the surge limit PG, in order to operate the compressor 10 in the stable operating range.

Figure 2:
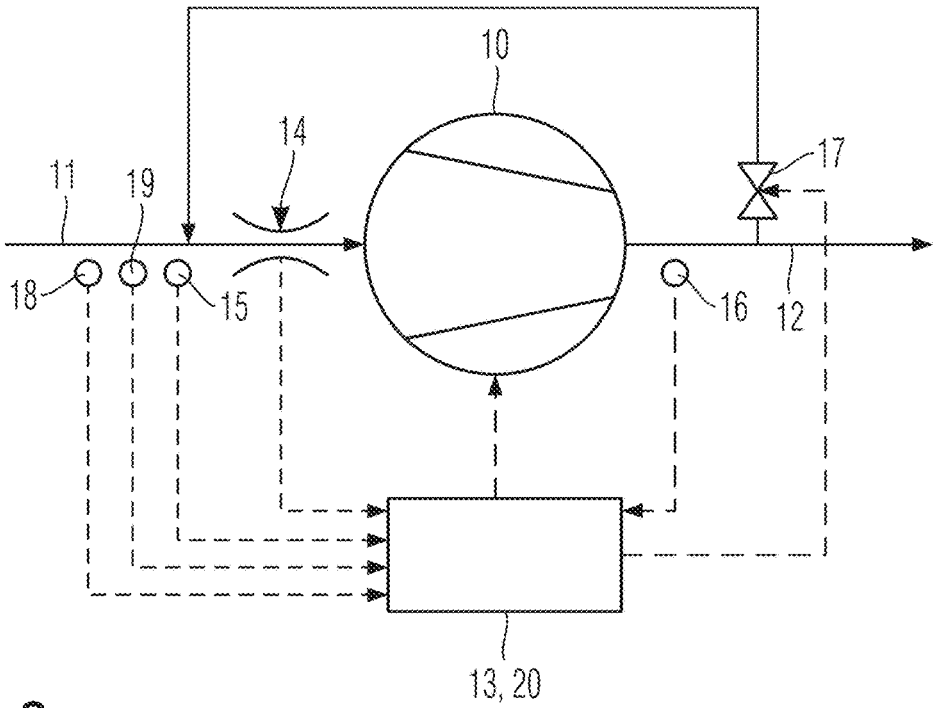
FIG. 2: is a schematic block diagram of a second compressor.

For this purpose, the surge limit controller 20 or the control unit 13 acts on a valve 17. In FIG. 1, this valve 17 is embodied as a blow-off valve. When the surge limit controller 20, dependent on the flow rate VS or the variable corresponding to the flow rate VS and dependent on the delivery head FH or the variable corresponding to the delivery head FH determines that the compressor 10 is no longer operated along the control line RL, but with insufficient distance from the surge limit PG, the control unit 13 or the surge limit controller 20 of the same outputs a control variable for the valve 17 serving as control element in order to blow-off a part of the compressed process gas. Compared with this, FIG. 2 shows a version of the invention, in which the valve 17 is not formed as a blow-off valve but as a return valve in order to return a part of the compressed process gas in the direction of the feed line 11 of the compressor 10.

Figure 4:
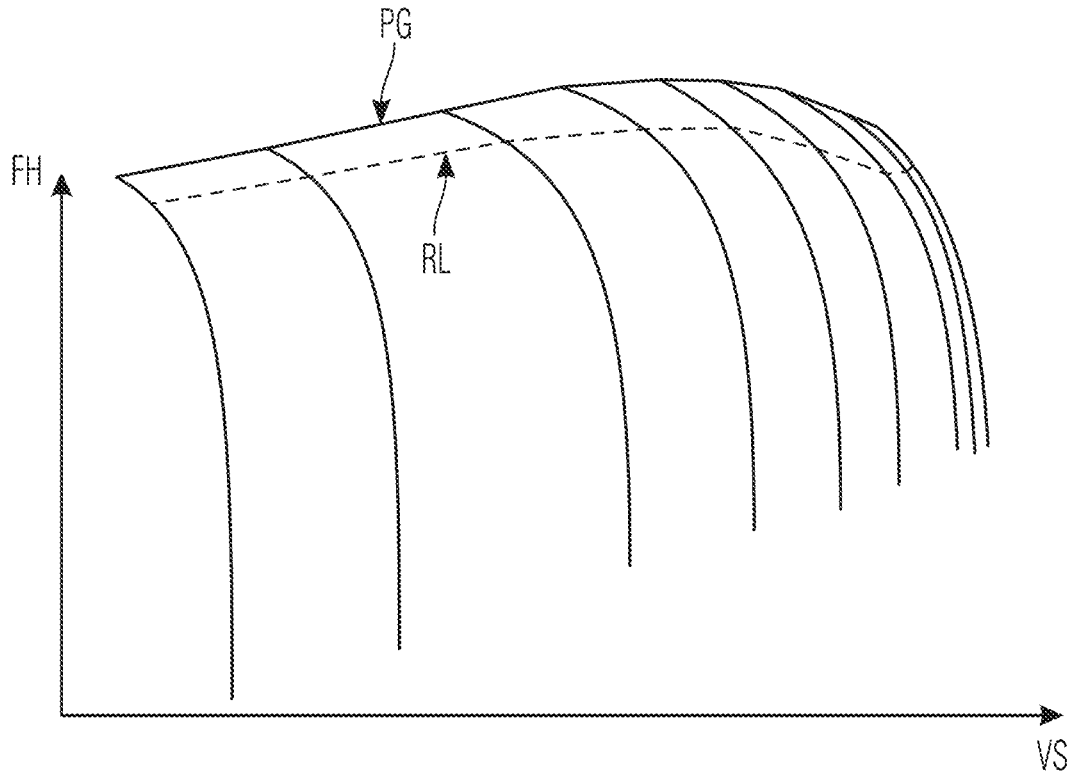
FIG. 4: is a second flow rate-delivery head characteristic diagram.

When the process gas to be compressed is a gas with dynamically changing proportion of steam, the characteristic diagram of the compressor 10 and thus also the surge limit PG of the same changes dependent on the proportion of steam. Accordingly, FIG. 4 shows a flow rate-delivery head characteristic diagram analogous to FIG. 3, however with a higher proportion of steam of the process gas to be compressed. When with the flow rate-delivery head characteristic diagram of FIG. 4 the surge limit controller where to use the control line RL of FIG. 3, this would, under certain conditions, lead to an unstable operation of the compressor 10. Thus, the proportion of steam of the process gas or a variable corresponding to the proportion of steam is determined according to the invention. According to FIG. 1, 2, this takes place with the help of a dewpoint mirror hygrometer 18, which measures the dewpoint of the process gas to be compressed and provides the measured dew point to the control unit 13 as input variable.

Dependent on the measured dew point, the control unit 13 can determine the proportion of steam of the process gas to be compressed in particular dependent on the characteristic diagram or dependent on the characteristic curve.

However it is also possible that a dewpoint mirror hygrometer 18 directly determines and provides to the control unit 13 the proportion of steam of the process gas to be compressed.

Dependent on the proportion of steam or the variable corresponding to the proportion of steam, the control unit 13 adapts the control characteristic curve RL of the surge limit controller, in particular dependent on the characteristic diagram or dependent on the characteristic curve, in order to always ensure a stable operation of the compressor 10 dependent on the proportion of steam of the process gas. The control unit 13 can adapt the control line RL in such a manner that the same, dependent on the proportion of steam or the variable corresponding to the proportion of steam, determines a gas constant of the process gas, for example dependent on the characteristic diagram or dependent on the characteristic curve. From the gas constant determined dependent on the proportion of steam, the control line RL can then be adapted in particular dependent on the characteristic diagram or dependent on the characteristic curve.

Accordingly, the control line RL of the surge limit controller is adapted dependent on the gas constant and thus dependent on the proportion of steam or the variable corresponding to the proportion of steam.

In FIGS. 1 and 2 it is provided, furthermore, to measure with the help of a temperature sensor 19 the temperature of the process gas to be compressed upstream of the compressor 10 and provide to the control unit 13 a corresponding temperature measurement value. In this further development of the invention it is provided that the control unit 13 adapts the control line RL on the one hand dependent on the proportion of steam and on the other hand dependent on the temperature of the process gas, in particular dependent on the characteristic diagram or dependent on the characteristic curve.

Furthermore, the invention relates to the control unit 13 with the surge limit controller 20, which is equipped to automatically carry out the method described above on the control side.

To this end, the control unit 13 comprises data interfaces in order to exchange data with the assemblies involved in carrying out the method according to the invention, thus for example with the effective pressure transducer 14, the pressure sensors 15, 16, the dewpoint mirror hygrometer 18 and the temperature sensor 19. Input data from all these assemblies are provided to the control unit 13. As output data, the control unit 13 outputs operating parameters from the compressor 10 and the valve 17.

The control unit 13 is equipped to adapt the control line RL of the surge limit controller of the same dependent on the proportion of steam of the process gas or the variable corresponding to the proportion of steam and preferentially also dependent on the temperature of the process gas to be compressed in particular dependent on the characteristic diagram or dependent on the characteristic curve.

With the invention, the control line RL of a surge limit controller can be highly dynamically adapted in the range of less than a second, in particular in the order of magnitude of 50 milliseconds, dependent on the proportion of steam of the process gas to be compressed. The solution according to the invention is quick and cost-effective.

Thus, while there have shown and described and pointed out fundamental novel features of the invention as applied to a preferred aspect thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A method for operating a compressor configured to compress a process gas, comprising:

determining a flow rate of the process gas through the compressor or a variable corresponding to the flow rate;

determining a delivery head of the compressor or a variable corresponding to the delivery head dependent on a measured inlet pressure of the compressor and dependent on a measured outlet pressure of the compressor;

determining, by a surge limit controller, a control variable for a control element interacting with the compressor dependent on the flow rate or the variable corresponding to the flow rate and dependent on the delivery head or the variable corresponding to the delivery head;

operating the compressor along a control line, which has a defined distance from a surge limit of the compressor;

determining a proportion of steam of the process gas or a variable corresponding to the proportion of steam; and adapting the control line, along which the compressor is operated, dependent on the proportion of steam or the variable corresponding to the proportion of steam.

2. The method according to claim 1, further comprising:

measuring the proportion of steam of the process gas.

3. The method according to claim 1, further comprising:

measuring a dewpoint of the process gas; and determining the proportion of steam determined dependent on the dew point.

4. The method according to claim 3, wherein the dewpoint of the process gas is measured with a dewpoint mirror hygrometer.

5. The method according to claim 1, further comprising:

measuring a temperature of the process gas upstream of the compressor; and adapting the control line, along which the compressor is operated dependent on the temperature of the process gas upstream of the compressor.

6. The method according to claim 1, further comprising:

determining the variable of a gas constant of the process gas corresponding to the proportion of steam or the variable corresponding to the proportion of steam; and adapting the control line, along which the compressor is operated dependent on the gas constant of the process gas and dependent on the proportion of steam or the variable corresponding to the proportion of steam.

7. A control unit configured to: operate a compressor, to compress a process gas, configured to:

determine a flow rate of the process gas through the compressor or a variable corresponding to the flow rate;

determine a delivery head of the compressor or a variable corresponding to the delivery head dependent on a measured inlet pressure of the compressor and dependent on a measured outlet pressure of the compressor;

determine, by a surge limit controller of the control unit, a control variable for a control element interacting with the compressor dependent on the flow rate or the variable corresponding to the flow rate and dependent on the delivery head or the variable corresponding to the delivery head such that the compressor is operated along a control line, which has a defined distance from a surge limit of the compressor; and adapt the control line, along which the compressor is operated, dependent on a proportion of steam of the process gas or the variable corresponding to the proportion of steam.

* * * * *